United States Patent [19]

Reiling

[11] Patent Number: 4,892,218

[45] Date of Patent: Jan. 9, 1990

[54] LID CONTROL DEVICE FOR REFUSE CONTAINERS

[76] Inventor: Raymond J. Reiling, 620 Elm St., Coon Rapids, Iowa 50058

[21] Appl. No.: 252,543

[22] Filed: Oct. 3, 1988

[51] Int. Cl.[4] ..... B65D 25/00

[52] U.S. Cl. ..... 220/263; 220/1 T

[58] Field of Search ..... 220/263, 262, 255, 1 T

[56] References Cited

U.S. PATENT DOCUMENTS

| | | | |
|---|---|---|---|
| 1,837,221 | 12/1931 | Kamenstein | 220/263 |
| 1,938,013 | 12/1933 | Folsom et al. | 220/263 X |
| 4,335,828 | 6/1982 | Robinson et al. | 220/1 T X |
| 4,361,247 | 11/1982 | Williams | 220/263 X |
| 4,697,380 | 10/1987 | Fenske | 220/263 X |
| 4,722,270 | 2/1988 | Wall | 220/1 T X |
| 4,771,940 | 9/1988 | Taylor | 220/1 T X |
| 4,775,066 | 10/1988 | Keppeler | 220/1 T |

*Primary Examiner*—Steven M. Pollard
*Attorney, Agent, or Firm*—Zarley, McKee, Thomte, Voorhees & Sease

[57] ABSTRACT

A lid control device for refuse containers having a linkage system including a normally horizontally disposed foot pedal arm mounted on the end of the container at its lower portion. One end of the pedal arm terminates in a foot pedal, and the arm is pivoted to the container near its center portion. The other end of the arm is pivotally secured to a vertically disposed lifting arm which extends vertically upwardly. The upper end of the arm terminates in a horizontal flange. The upper end of the lifting arm extends through a keeper bracket on the upper edge of the container. The keeper bracket is located rearwardly of the conventional lifting bracket secured to the end of the container which is used by refuse trucks in lifting the container. The horizontal flange on the upper end of the lifting arm engages the lower surface of the lid on the container. Preferably, if the lid is comprised of plastic, a slide plate is mounted on the lower surface of the lid to engage the horizontal flange of the lifting arm. When pressure is applied to the foot pedal, the lifting arm rises to engage the lower surface of the lid causing the lid to pivot upwardly to an open position.

8 Claims, 2 Drawing Sheets

LID CONTROL DEVICE FOR REFUSE CONTAINERS

BACKGROUND OF THE INVENTION

Heavy wheel-mounted refuse containers adapted to be lifted by the lifting mechanism of large refuse trucks are very common. These containers are generally rectangular in shape and have one or two lids pivotally secured to the top. The lids are manually raised and the refuse is deposited therein. When the refuse containers are partially or substantially full, the refuse trucks back up towards the forward portion of the containers, the lifting mechanism of the trucks are engaged with the containers, and the containers are raised and dumped, and the contents thereof are dumped into the truck. The container is then lowered to the ground or supporting surface to be manually filled again over a period of time.

One of the great drawbacks of these refuse containers is that the lids must be manually raised and held in an open position while the refuse is dumped therein. This means that the person doing the dumping must lift the bag of refuse or the like with one hand while the other hand is used to hold the lid in an open condition. This makes the placement of refuse in the container difficult for many younger and older people and inconvenient for all persons.

Therefore, a principal object of this invention is to provide a lid control device for refuse containers which will permit the person dumping the refuse to actuate the lids with a foot pedal, thus freeing both hands to manipulate the refuse being dumped.

A further object of this invention is to provide a lid control device for refuse containers which will allow the refuse container lids to automatically close by gravity after the refuse has been deposited therein.

A still further object of the invention is to provide a lid control device for refuse containers that will be completely free of the lifting mechanism of the refuse truck so that no damage will occur to the lid control device while the container is being dumped into the refuse truck.

A further object of the invention is to provide a lid control device for refuse containers which can be mounted on existing refuse containers.

A still further object of the invention is to provide a lid control device for refuse containers that is economical in manufacture and durable in use.

These and other objects will be apparent to those skilled in the art.

SUMMARY OF THE INVENTION

The lid control device of this invention for refuse normally horizontally disposed foot pedal arm mounted on the end of the container at its lower portion. One end of the pedal arm terminates in a foot pedal, and the arm is pivoted to the container near its center portion. The other end of the arm is pivotally secured to a vertically disposed lifting arm which extends vertically upwardly. The upper end of the arm terminates in a horizontal flange. The upper end of the lifting arm extends through a keeper bracket on the upper edge of the container. The keeper bracket is located rearwardly of the conventional lifting bracket secured to the end of the container which is used by refuse trucks in lifting the container.

The horizontal flange on the upper end of the lifting arm engages the lower surface of the lid on the container. Preferably, if the lid is comprised of plastic, a slide plate is mounted on the lower surface of the lid to engage the horizontal flange of the lifting arm.

When pressure is applied to the foot pedal, the lifting arm rises to engage the lower surface of the lid causing the lid to pivot upwardly to an open position.

DESCRIPTION OF THE PREFERRED EMBODIMENT

Figure 1:
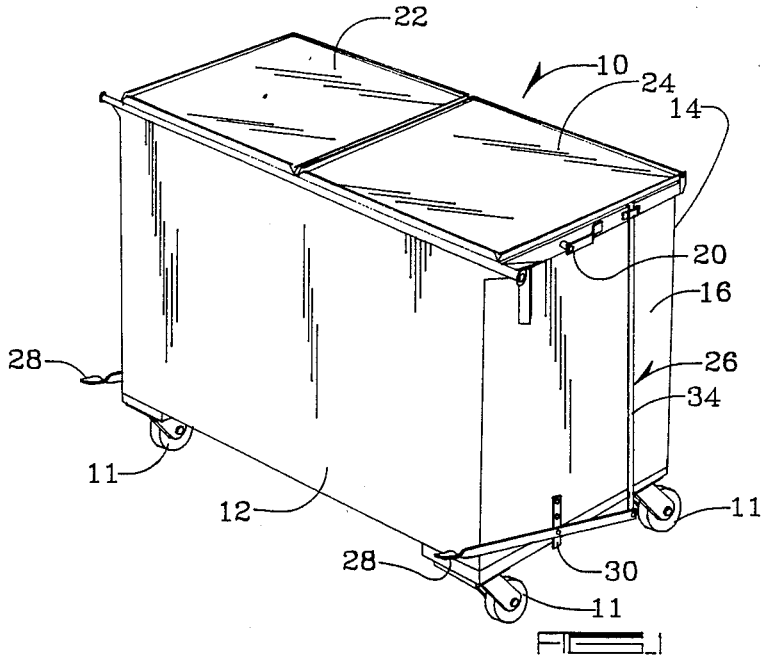
FIG. 1 is a perspective view of a refuse container with the lid control device mounted thereon.
Figure 2:
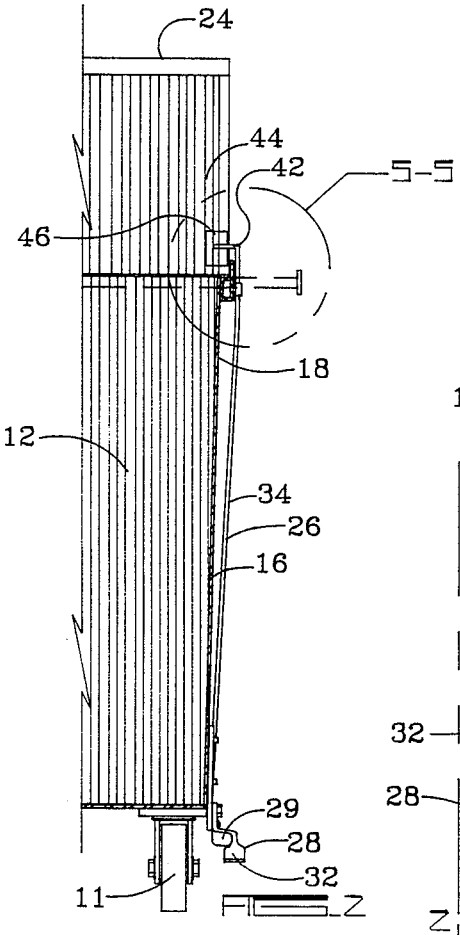
FIG. 2 is a partial elevational view taken on line 2—2 of FIG. 3.

The numeral 10 designates a conventional refuse container having a front wall 12, a rear wall 14, and end walls 16. Conventional caster wheels 11 are secured to the bottom of the container 10. The upper edges of the front, rear and end walls comprise an upper perimeter 18. Conventional lifting brackets 20 are secured to opposite ends of the end walls near the upper portion thereof and are adapted to receive chains or the like of the lifting mechanism of the refuse truck. Lids 22 and 24, made of lightweight plastic, are pivotally secured to the container at the rearward portion of perimeter 18.

Linkage means 26 comprises pedal arm 28 arm 28 having forward and rearward ends. The pedal arm 28 is pivotally secured to the container 10 by a pivot bracket 30 located at the lower central portion of the end walls. The forward end of foot pedal arm 28 terminates in foot pedal 32. The foot pedal arm 28 is twisted at 29 to provide offset clearance for pedal 32 with respect to the adjacent wheel 11.

A lifting arm 34 having a lower end 36 and an upper end 38 has its lower end pivotally secured to the rearward end of foot pedal 32 by any convenient means. The upper end 38 extends through a keeper bracket 40 which is located rearwardly of the lifting bracket 20. The upper end 38 of lifting arm 34 terminates in a horizontal flange 42 which is adapted to engage the lower surface 44 of one of the lids 18 or 20. A slide plate 46 is secured by any convenient means to the lower surface of the lids to engage the horizontal flange 42. Slide plate 46 inhibits wear occurring to the lids.

Figure 3:
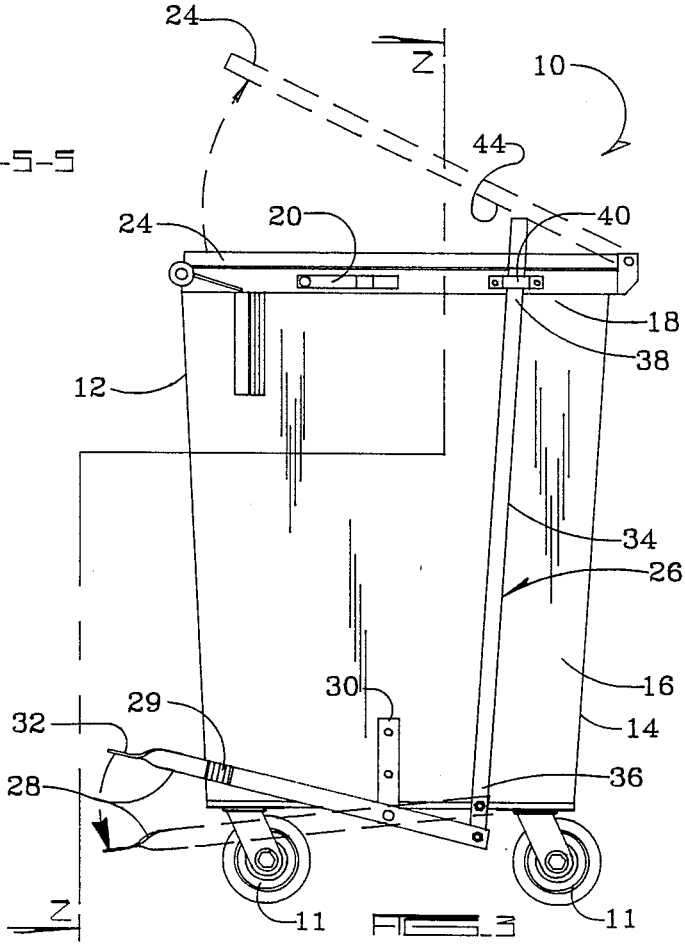
FIG. 3 is an end elevational view. The dotted lines in FIG. 3 show a lid in an open condition.
Figures 4, 5:
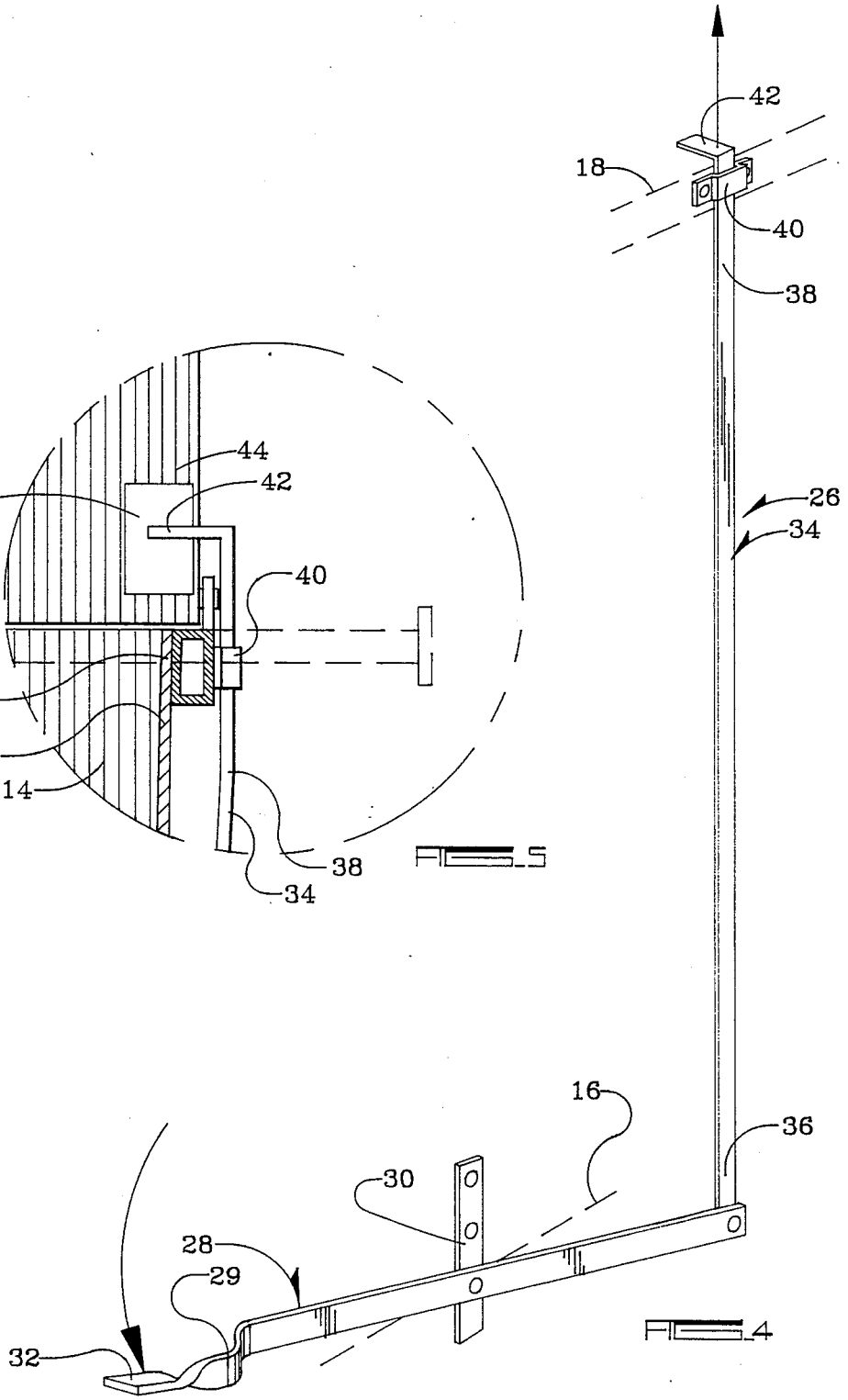
FIG. 4 is an enlarged scale perspective view of the lid control device of this invention.
FIG. 5 is an enlarged scale detail of the portion of FIG. 2 designated by the alliance 5—5.

In operation, the operator depresses the foot pedal 32 which causes the lifting arm 34 to slidably rise through keeper bracket 40. The upper end of lifting arm 34 engages the underside of one of the lids, causing the lid to pivot upwardly, as shown by the dotted lines of FIG. 3. While the operator keeps the foot on the foot pedal, the foot pedal is depressed to the position shown by the dotted lines in FIG. 3. The operator is then free to use both hands to throw trash or refuse into the container 10. As soon as the foot is removed from pedal 32, the weight of the lid depresses the lifting arm 34, causing the pedal 32 to resume its normal position.

When the refuse trucks comes to empty the container 10, the conventional lifting mechanism can be secured to lifting brackets 20 without interfering or otherwise damaging the lifting arms 34 or any other part of the linkage means 26.

Conventionally, the lids 22 and 24 can be pivoted 270° to a completely open position, if required, but it is not necessary for this to be accomplished by the linkage means 26 in most uses of the container. A linkage means 26 can be mounted on both ends of the container 10, if desired, to accommodate both of the lids 22 and 24.

Thus, it is seen that the device of this invention will accomplish at least its stated objectives.

I claim:

1. In combination with a rectangular refuse container having a generally rectangular body with a bottom, front and rear walls, opposite end walls, an open top, defined by a rim portion comprising the upper ends of said front, rear and end walls, at least one closable lid extending across said open top and hinged adjacent the upper end of said rear wall, and lifting brackets secured to said upper ends of said end walls between the front and rear walls and located substantially on said rim portion to facilitate grasping of said container by the lifting mechanism of a refuse truck located forwardly of said container, the improvement comprising, a linkage means secured to said container to permit the selective pivotal raising of said lid for purposes of depositing refuse in said container, said linkage means comprising a generally horizontal foot pedal arm pivotally secured adjacent its center portion to the bottom portion of one of said end walls, said foot pedal arm having a forward end terminating in a foot pedal means, a vertically disposed lifting arm having upper and lower ends and pivotally secured by its lower end to the other end of said foot pedal arm, a keeper bracket means secured to said rim portion rearwardly of one of said lifting brackets and slidably receiving the upper end of said lifting arm, the position of said keeper bracket freeing said lifting arm from engagement with said lifting mechanism of said refuse truck when said container is grasped thereby, the upper end of said lifting arm normally positioned at the approximate level of said rim and engaging said lid whereby when said foot pedal is depressed downwardly, said lifting arm will rise and pivot said lid upwardly to permit refuse to be deposited in said container.

2. The combination of claim 1 wherein two lids are pivotally secured to said container, and a linkage means is mounted on each of the opposite ends of said container to permit selective operation of each of said lids.

3. The combination of claim 1 wherein the weight of said lid on the upper end of said lifting arm will close said lid when downward depressing pressure is released from said foot pedal.

4. The combination of claim 1 wherein the upper end of said lifting arm terminates in a substantially horizontal flange what engages the lower surface of said lid.

5. The combination of claim 4 wherein a slide plate is mounted on the lower surface of said lid to engage the upper end of said lifting arm.

6. The combination of claim 1 wherein a slide plate is mounted on the lower surface of said lid to engage the upper end of said lifting arm.

7. The combination of claim 1 wherein the upper end of said arm engages the lower surface of said lid.

8. The combination of claim 1 wherein said foot pedal is outwardly offset with respect to said foot pedal arm.

* * * * *